US005738705A

United States Patent [19]

Anderson et al.

[11] Patent Number: 5,738,705

[45] Date of Patent: Apr. 14, 1998

[54] ATOMIZER WITH LIQUID SPRAY QUENCHING

[75] Inventors: Iver E. Anderson; Matthew G. Osborne; Robert L. Terpstra, all of Ames, Iowa

[73] Assignee: Iowa State University Research Foundation, Inc., Ames, Iowa

[21] Appl. No.: 560,711

[22] Filed: Nov. 20, 1995

[51] Int. Cl.[6] ..... B22F 9/10

[52] U.S. Cl. ..... 75/332; 75/334; 75/338

[58] Field of Search ..... 75/332, 333, 334, 75/337, 338

[56] References Cited

U.S. PATENT DOCUMENTS

| | | | |
|---|---|---|---|
| 1,782,038 | 11/1930 | Haak . | |
| 2,217,235 | 10/1940 | Rieser . | |
| 2,439,772 | 1/1948 | Gow . | |
| 3,646,176 | 2/1972 | Ayers | 264/11 |
| 4,127,158 | 11/1978 | Matsuno . | |
| 4,217,082 | 8/1980 | Bourdeau | 425/8 |
| 4,224,260 | 9/1980 | Dain et al. | 75/337 |
| 4,298,553 | 11/1981 | Ayers | 264/11 |
| 4,343,750 | 8/1982 | Holiday et al. | 75/334 |
| 4,952,144 | 8/1990 | Hansz et al. | 425/10 |
| 5,372,629 | 12/1994 | Anderson et al. | 75/338 |

FOREIGN PATENT DOCUMENTS

| | | | |
|---|---|---|---|
| 59-226104 | 12/1984 | Japan | 75/334 |
| 4-325607 | 11/1992 | Japan | 75/333 |

*Primary Examiner*—George Wyszomierski
*Attorney, Agent, or Firm*—Edward J. Timmer

[57] ABSTRACT

Method and apparatus for making metallic powder particles wherein a metallic melt is atomized by a rotating disk or other atomizer at an atomizing location in a manner to form molten droplets moving in a direction away from said atomizing location. The atomized droplets pass through a series of thin liquid quenching sheets disposed in succession about the atomizing location with each successive quenching sheet being at an increasing distance from the atomizing location. The atomized droplets are incrementally cooled and optionally passivated as they pass through the series of liquid quenching sheets without distorting the atomized droplets from their generally spherical shape. The atomized, cooled droplets can be received in a chamber having a collection wall disposed outwardly of the series of liquid quenching sheets. A liquid quenchant can be flowed proximate the chamber wall to carry the cooled atomized droplets to a collection chamber where atomized powder particles and the liquid quenchant are separated such that the liquid quenchant can be recycled.

10 Claims, 4 Drawing Sheets

ATOMIZER WITH LIQUID SPRAY QUENCHING

CONTRACTURAL ORIGIN OF THE INVENTION

The United States Government has rights in this invention pursuant to Contract No. W-7405-ENG-82 between the U.S. Department of Energy and Iowa State University, Ames, Iowa, which contract grants to Iowa State University Research Foundation, Inc. the right to apply for this patent.

FIELD OF THE INVENTION

The present invention relates to manufacture of powder particulates by atomization of metallic material including metals, alloys, intermetallics, and the like and quenching the molten droplets of the material using a series of liquid quenching curtains or sheets disposed about a central atomizing location such that the atomized molten droplets pass successively through the quenching curtains or sheets for rapid cooling.

BACKGROUND OF THE INVENTION

Atomization of molten metallic materials such as metals, alloys, intermetallics, and the like is widely employed to produce powders of the particular material. When the metallic material includes a chemically reactive alloy component, such as for example a reactive rare earth element, there is a need to passivate or coat the powder particles with a layer that is passive to the environment to prevent the particles from reacting with ambient air during subsequent processing, storage or use. A method of coating high pressure gas atomized reactive powder to this end is described in the Anderson et al. U.S. Pat. Nos. 5,125,574 and 5,372,629 wherein a gaseous reactant, such as for example nitrogen, is disposed in a drop tube downstream of the atomizing location to react with at least surface solidified, atomized droplets as they fall through the reactive zone to from a thin protective coating or layer thereon.

Another atomization technique known as the rapid solidification rate (RSR) process involves pouring molten material onto a rotating disk such that the molten material is centrifugally ejected to form droplets that impinge high velocity jets of inert gas, such as He, arranged about the rotating disk. However, the arrangement of gas jets about the rotating atomizing disk requires a large atomization chamber since forced convection cooling rates are lower for gases as compared to liquids due to lower gas density and gas heat capacity.

Another atomization technique is known wherein molten material is poured onto a rotating disk such that the molten material is centrifugally ejected to form droplets that impinge a liquid quenching bath. However, this technique suffers from the disadvantage that the molten droplets that do not solidify before they strike the relatively massive liquid quenchant bath are distorted from their generally spherical atomized shape when they do strike the quenching bath. This technique is further disadvantageous when it is considered that spherical atomized powder is highly desired for use in many technological applications.

A rotating electrode process (REP) also is known wherein a consumable electrode is melted by an electric arc exisitng between it and a non-consumable electrode. The consumable electrode is rapidly rotated and atomization occurs at the electrode face. While this technique produces clean, spherical particles, the technique typically cannot be used for atomizing brittle materials or materials with large melting ranges. For example, fabrication and subsequent rapid spinning of brittle electrodes can be very difficult, if not impossible for some materials. For materials with large melting ranges, REP atomized alloy powders typcially can exhibit an undesireable wide variation in alloy composition.

Moreover, most metals form a surface oxide layer when exposed to an atmosphere containing a significant partial pressure of oxygen, particularly when exposed to the oxygen contained in ambient air. Some metals, such as aluminum, magnesium, titanium, and the rare earths, are extraordinarily reactive and will combine readily with oxygen to form their own base metal oxide or "native" oxide. To reduce the severe hazard of explosions, reactive metals like these typically are "passivated" by purposeful reaction with air or oxygen mixed with an inert gas during a powder production process.

Since metal powders have a high surface area to volume ratio, the amount of reacted material can be an appreciable fraction of the total metal mass. The formation of heavy native oxide surface layers as well as non-sherical particle shape are typically detrimental to the physical and chemical properties of metals, especially for applications requiring rapid thermal or chemical transport through contacting powder surfaces and into adjacent powder particles; e.g. for diffusive sintering of powder compacts or for a heat exchanger bed in a cryocooler regenerator. In addition to inhibiting transport, native oxide powder surface layers can continue to grow and spall off, especially in the rare earth metals and alloys.

SUMMARY OF THE INVENTION

The present invention provides method and apparatus for making powder particulates that overcome the disadvantages enumerated hereabove by using a plurality of liquid quenching curtains or sheets arranged about a central atomizing location in a manner that atomized molten droplets pass successively through the quenching curtains or sheets for rapid cooling.

Apparatus in accordance with one embodiment of the present invention comprises means disposed at an atomizing location for atomizing metallic melt in a manner to form molten droplets moving in a flight path or direction away from the atomizing location. The atomizing means may comprise a rotating atomizing disk to which the melt is supplied and centrifugally ejected as atomized droplets. A series of liquid quenching curtains or sheets is disposed in succession about the atomizing location with each successive quenching sheet being at an increasing distance from the atomizing location. For example only, a plurality of liquid quenching curtains or sheets are disposed concentrically about a rotational axis of a rotating atomizing disk at successively increasing distances from the disk outer diameter.

Apparatus and method of the invention are especially useful in making generally spherical powder particles wherein the liquid quenching curtains or sheets are controlled to be thin enough that the atomized droplets are incrementally cooled as they pass through the series of liquid quenching sheets without substantially distorting the atomized droplets from the generally spherical droplet shape assumed by the droplets as they move from the atomizing location. The invention however is not limited to production of generally spherical particle shapes and can be practiced to make particles of other shapes by adjustment of certain parameters.

Moreover, if desired, the present invention envisions reacting at least one of the liquid quenching curtains or sheets with the droplets to form an environmentally protective coating or layer on the droplets as they pass through one or more of the quenching curtains or sheets. The quenchant itself may be reactive to this end or a reactive additive can be provided in the quenchant effective to this end.

In one embodiment of the present invention, each of the liquid quenching curtains or sheets is formed by a pluraility of quenchant discharge nozzles arranged in a circular pattern about the atomizing location. Each nozzle in a pattern discharges liquid quenchant as a flat spray that overlaps the like flat sprays of adjacent nozzles in a manner to collectively form a polygonal cross-section liquid quenching curtain or sheet enclosing the atomizing location, the polygonal cross-section liquid quenching curtains or sheets being disposed concentrically about the atomizing location.

In another embodiment of the present invention, after passing through the series of liquid quenching sheets, the atomized droplets impinge an outermost liquid quenchant flow provided proximate a wall in the atomizing chamber disposed outwardly of the series of liquid quenching sheets and defining a particle collection zone. The liquid quenchant flow proximate the wall fully solidifies the droplets and entrains and carries the solidified powder particles to a collection chamber where the atomized powder particles and the liquid quenchant are separated by settling such that the liquid quenchant can be recycled for use. For example, the collection chamber is disposed in a reservoir of the liquid quenchant and communicates thereto via a filtering means that permits the separated liquid quenchant to flow from the collection chamber into the reservoir for pumping back to the nozzles.

A method in accordance with an embodiment of the present invention includes atomizing a metallic melt at an atomizing location in a manner to form molten droplets moving in a flight path or direction away from the atomizing location, passing the atomized droplets through a series of liquid quenching curtains or sheets disposed in succession about the atomizing location with each successive quenching sheet being at an increasing distance from the atomizing location so that the atomized droplets pass through the liquid quenching sheets in succession, and incrementally cooling the atomized droplets as they pass through the series of liquid quenching sheets. A particular embodiment of the method involves atomizing the metallic melt in a non-reactive or inert atmosphere and then optionally reacting the atomized droplets with at least one of the liquid quenchant curtains or sheets or reactant therein to form a protective coating on the atomized droplets. Generally spherical powder particles are produced by passing the molten droplets through the liquid quenching curtains or sheets that are thin enough to incrementally cool the droplets without distorting them from the generally spherical shape assumed by the droplets as they travel from the atomizing location.

The aforementioned objects and advantages of the present invention will become more readily apparent from the following detailed description taken with the following drawings.

DETAILED DESCRIPTION OF THE INVENTION

Figure 1:
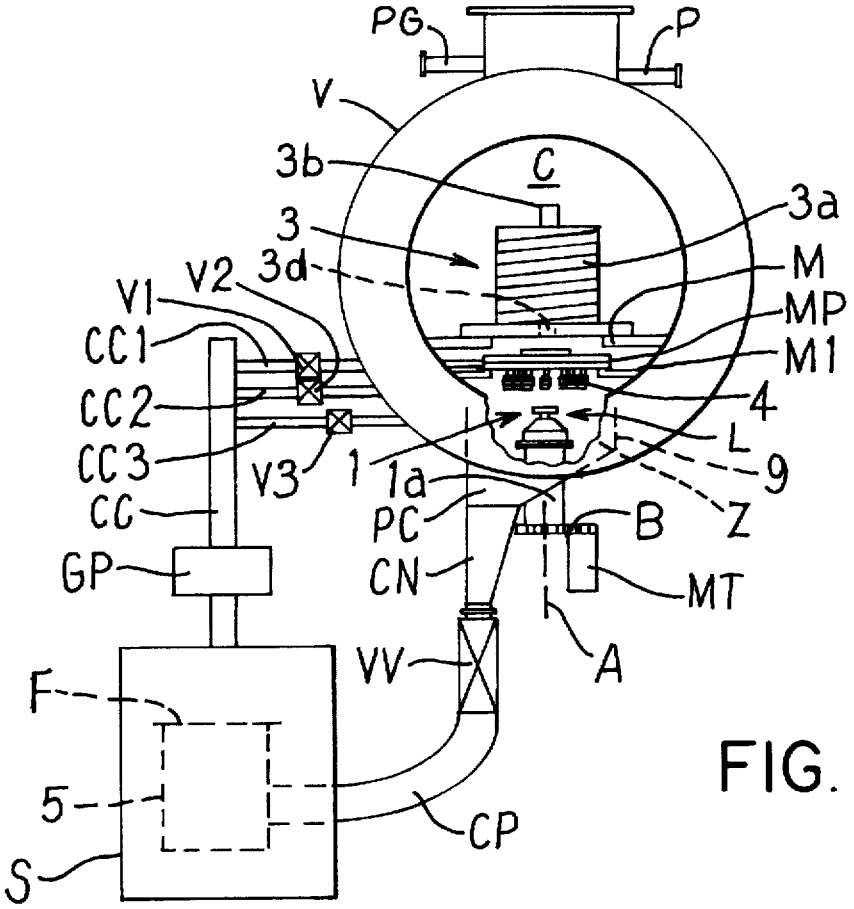
FIG. 1 is a schematic illustration of apparatus in accordance with an embodiment of the present invention for practicing a method of the invention to make metallic powder particles, the lower region of the vessel being broken away to reveal the centrifugal atomizing disk and bearing housing in that region.

Referring to FIG. 1, apparatus for making metallic powder particles in accordance with an embodiment of the present invention is illustrated schematically. One atomizing apparatus embodiment comprises an induction heated crucible 3 (or other melting vessel) in an atomizing and melting chamber C of a vessel V. The vessel V can be evacuated through a port P communicated to a conventional vacuum pump (not shown) and subsequently back-filled with inert or non-reactive gas through the port PG communicated to a conventional bottle, cylinder or other source (not shown) of inert gas, such as argon, or other gas not reactive with the melt to be atomized.

The crucible 3 is supported in the vessel V by support members M that are supported on the vessel walls and contains the metallic melt to be atomized. Typically, a solid metal charge is melted in the crucible 3 and further heated typically to a preselected melt superheat above the liquidus temperature by energization of induction coils 3*a* disposed about the crucible. The crucible 3 includes a stopper rod 3*b* that is opened relative to a bottom crucible melt discharge orifce 3*d* by vertical action of a pneumatic actuator1 (not shown) so as to discharge the melt when the stopper rod is raised. The atomizing chamber C typically is initially evacuated such as, for example, to $10^{-5}$ atmospheres and then pressurized with ultra-high purity argon, helium, or other inert or nonreactive gas to 1.1 atmospheres prior to melting and discharge of the metallic melt from the crucible 3.

Upon raising of the stopper rod 3*b*, the melt is fed by gravity through the crucible orifice 3*d* (diameter of about 0.1 inch) through an opening O (e.g. 1.5 inches diameter) of nozzle manifold plates MP disposed by support members M1 on the vessel walls with opening 0 aligned axially with the orifice 3*d* and then onto an atomizing disk 1 that is rotated at a predetermined speed about vertical rotational axis A via toothed drive belt B and motor MT. The disk 1 is connected to a drive shaft 1*b* mounted in a bearing housing 1*a* and rotated via motor MT. The melt discharges as a stream that strikes the rotating disk 1 disposed at a central atomizing location L in the chamber C. The stream strikes the rotating disk 1 proximate the disk center and then flows across the disk surface to its periphery where the melt breaks apart into molten atomized droplets that are flung or directed by centrifugal force as an atomized spray from the disk periphery as illustrated, for example, in FIG. 3. The rotational speed of the disk 1 can be controlled to control the size of the atomized droplets within a selected or given range.

The rotating disk 1 typically comprises a refractory material such as tantalum or alumina, although the disk can be made of other materials that are compatible with the melt discharged from the crucible 3 for atomization.

Although melt atomization by rotating disk 1 is illustrated in FIGS. 1–4, the invention is not so limited and can be practiced using other atomization techniques, such as rotating electrode atomization, spinning cup atomization, and the like to generate a spray of atomized droplets with clean, nascent surfaces that travel in a flight path away from the atomizer.

Apparatus and method of the invention are especially useful in making generally spherical powder particles wherein the liquid quenching curtains or sheets are controlled thin enough that the atomized droplets are incrementally cooled as they pass through the series of liquid quenching sheets without substantially distorting the atomized droplets from the generally spherical droplet shape assumed by the droplets as they move from the atomizing location comprised of the atomizing disk 1. The invention can be used to make spherical powder particle sizes that range from about 50 to about 1000 microns in diameter, although other sizes may be made.

The invention however is not limited to production of spherical particle shapes and can be practiced to make particles of other shapes by adjustment of certain parameters such as the thickness of the liquid quenching curtains or sheets, the spacing between the liquid quenching curtains or sheets, liquid quenchant flow rates, composition of the liquid quenching curtains or sheets and the like.

Figure 2:
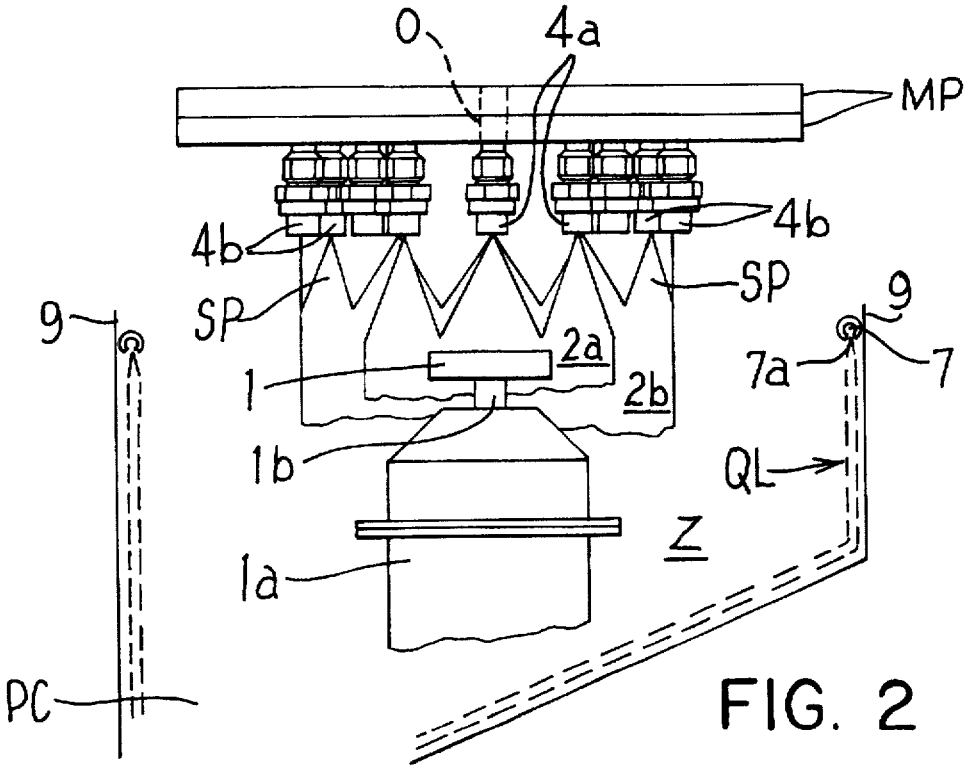
FIG. 2 is a schematic side elevation of the centrifugal atomizing disk, two concentric polygonal cross-section liquid quenching curtains or sheets through which the atomized droplets from the atomizing disk pass, and outermost liquid quenchant flow layer.
Figure 3:
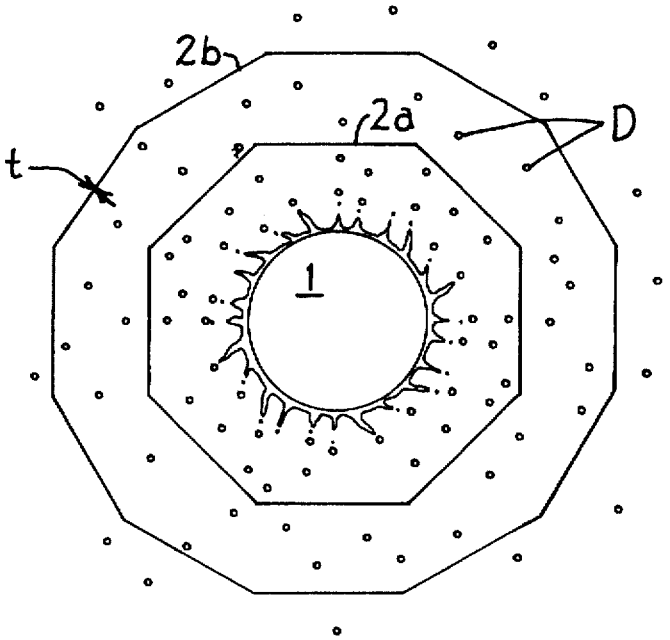
FIG. 3 is a schematic top elevational view of the atomizing disk illustrating atomized droplets leaving the disk and penetrating the two liquid quenching curtains or sheets represented schematically in cross section (horizontal cross section) by solid lines.

A plurality of liquid quenching sheets 2*a*, 2*b* are disposed in succession about the disk 1 at the atomizing location L with each successive quenching sheet being at an increasing distance from the disk 1. As shown in FIGS. 2 and 3, for example, the liquid quenching sheets 2*a*, 2*b* are disposed transverse to the flight path or direction of the droplets D from disk 1 and concentrically about the rotational axis A of the rotating atomizing disk 1 at successively increasing radial distances greater than the disk outer dimension; i.e. disk outer diameter. In making generally spherical powder particles pursuant to the invention, the curtains or sheets 2*a*, 2*b* are spaced apart radially to provide free flight time for additional convective cooling and spherical shape stabilization. To this same end, the liquid quenching sheets 2*a*, 2*b* are controlled thin enough that the atomized droplets D are incrementally cooled as they pass through the series of liquid quenching sheets 2*a*, 2*b* without substantially distorting the atomized droplets D from the generally spherical droplet shape assumed by the droplets as they move in their flight path from the atomizing disk.

Each of the liquid quenching sheets 2*a*, 2*b* is formed by a plurality of liquid quenchant discharge nozzles 4 arranged in a circular pattern about the disk 1 and spaced circumferentially apart in the pattern. For example, referring to FIG. 2, the circular pattern of nozzles 4*a* that form the inner curtain or sheet 2*a* is concentric with the circular pattern of nozzles 4*b* that form the outer curtain or sheet 2*b*. The nozzles 4*a*, 4*b* communicate with respective liquid quenchant manifolds (not shown) that are formed between manifold plates MP and that communicate with respective secondary liquid quenchant supply conduits CC1 and CC2 that in turn communicate with a primary liquid quenchant supply conduit CC. The secondary conduits CC1 and CC2 are valved by respective valves V1 and V2 to allow separate pressure control of the inner nozzles 4*a* forming the inner liquid quenchant curtain or sheet 2*a* and the outer nozzles 4*b* forming the outer liquid quenchant curtain or sheet 2*b*. The conduit CC is communicated to a gear pump GP that pumps liquid quenchant from the liquid quenchant reservoir or source S.

Figure 4:
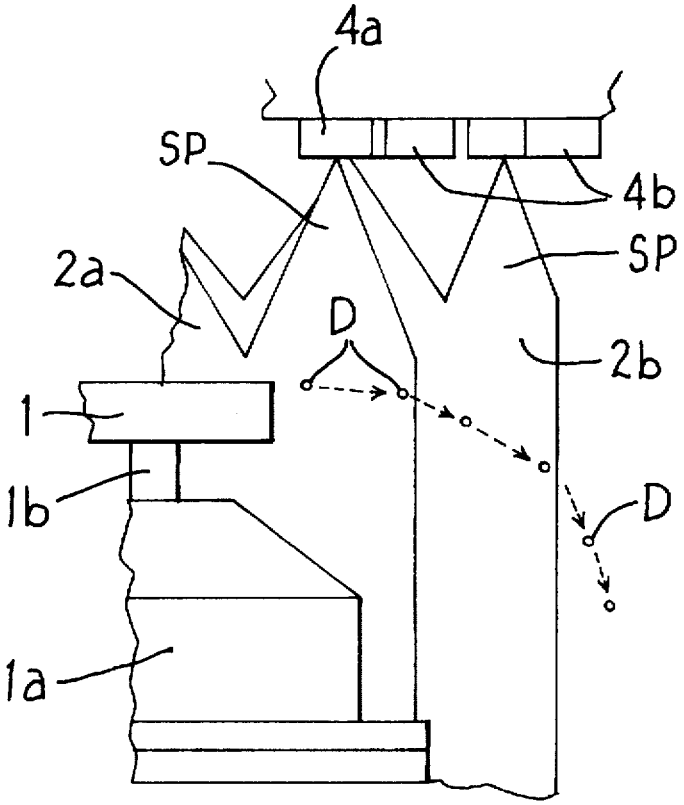
FIG. 4 is a partial schematic side elevation of the centrifugal atomizing disk and two concentric liquid quenching curtains or sheets through which the atomized droplets from the atomizing disk pass in succession.

As mentioned, in making generally spherical powder particles pursuant to the invention, each liquid quenching sheet 2*a*, 2*b* is formed thin enough that the atomized droplets D are cooled as they pass successively through each liquid quenching sheet without substantially distorting the atomized droplets D from the generally spherical droplet shape assumed by the droplets as they move from the atomizing disk 1. For example, FIG. 4 shows generally spherical droplets D exiting the last liquid quenchant sheet 2*b*. The thinness of the liquid quenching curtain or sheet is with reference to the cross-sectional dimension t, FIG. 3, of each curtain or sheet 2*a* or 2*b* and can be selected as needed to achieve a desired droplet cooling effect at each curtain or sheet 2*a*, 2*b* and yet remain thin enough to avoid substantially distorting the droplets from their generally spherical droplet shape as they penetrate and pass through the curtains or sheets 2*a*, 2*b*.

To this end, the nozzles 4 are selected to discharge the liquid quenchant as respective thin, flat sprays SP that overlap with the spray SP discharged from adjacent nozzles 4 to collectively form a thin, polygonal cross-sectional shaped liquid quenching curtain or sheet as illustrated schematically in FIG. 3 in solid lines. The liquid quenching curtains or sheets 2*a*, 2*b* enclose or surround the disk 1 in manner that the atomized droplets must pass therethrough as they are centrifugally ejected from the disk 1.

Suitable nozzles 4 for generating such thin, flat sprays SP shown in FIGS. 2–3 can comprise conventional flat spray nozzles available as type LF nozzles from Delevan-Delta Inc., Lexington, Tenn. In particular, type LF, flat spray nozzles #20 with 65 degree spray angle can be used as nozzles 4*b* for generating the outer liquid quenching curtain or sheet 2*b* and type LF, flat spray nozzles #10 with 65 degree spray angle can be used as nozzles 4*a* for generating the inner liquid quenching curtain or sheet 2*a*. The #20 or #10 designation by the nozzle manufacturer indicates ten times a nominal water flow rate in gallons per minute at a supplied pressure of 40 psi. These particular spray nozzles each discharge an individual spray SP as an expanding flat, planar (2-dimensional) spray that has a thinness not exceeding on the order of approximately 0.1 inch. In an illustrative embodiment of the invention using these aforementioned nozzles, the inner curtain or spray 2*a* can be generated by eight (8) nozzles spaced 45 degrees apart at a radius of 2 inches from the axis A and spraying straight down. The outer curtain or spray 2*b* can be generated by twelve (12) nozzles spaced 30 degrees apart at a radius of 3 inches from the axis A and spraying straight down. Each individual spray SP overlaps adjacent like sprays SP discharged from adjacent nozzles about the respective circular pattern to collectively form the respective liquid quenchant curtain or sheet 2*a* or 2*b*. Such nozzles can be supplied with liquid quenchant from source S by the gear pump GP at a pressure in the range of 2 to 10 psi.

The liquid quenchant supplied to the nozzles 4 and discharged as liquid quenching curtains or sheeets 2*a*, 2*b* can comprise a variety of liquids having physical and chemical properties selected in dependence upon the particular metallic material being atomized and the particular particle shape desired. For example, the liquid quenchant can comprise mineral oil, silicone oil, methyl alcohol, corn oil, and other liquids that can cool or quench the atomized droplets. The invention is not limited to any particular liquid quenchant. Moreover, the composition and pressure/flow rate of the liquid quenchant to the nozzles 4 can be controlled to vary the characteristics of the curtains or sheets 2*a*, 2*b* in manner to control the shape of the powder particles eventually solidified to produce generally spherical or other particle shapes as desired.

The liquid quenchant can include other additives such as a surfactant additive; e.g. an organometallic acid, such as phosphotungstic acid, to facilitate wetting of the atomized droplets D by the liquid quenchant and to promote formation of a chemically complex glassy surface coating on the as-quenched particles. Other additives can include, but are not limited to, organic polymers, such as starch, to promote formation of a crude polymer surface coating.

The liquid quenchant may include one or more additives or reactants selected to react with the atomized droplets as they contact one or more of the curtains or sheets 2*a*, 2*b* to form an environmentally protective coating on the atomized droplets. The liquid quenchant itself may be reactive with the droplets to this end. This is especially advantageous in making powder particles comprising a reactive metal or alloy including a reactive element with a coating that prevents deleterious reaction of the powder particles with ambient air during subsequent processing, storage and usage.

The protective passivation coating or film forms on the atomized droplets D while the droplets have a clean, nascent surface that promotes chemical bonding between the coating and solidified particle. Moreover, the coating is formed in-situ during atomization of the as-quenched powder particles and thereby avoids the need for powder reheating and secondary powder handling steps following atomization, which steps could introduce impurities to the powder and add to its production cost.

After passing through the series of liquid quenching curtains or sheets 2*a*, 2*b*, the atomized droplets preferably impinge a third liquid quenching flow layer QL spaced radially outwardly from curtain or sheet 2*b* and proximate a cylindrical, tubular wall member 9 defining a particle collection zone Z in the bottom region of the chamber C, FIG. 1 and 2. The cylindrical, tubular wall member 9 communicates at its bottom with an eccentric, cone-shaped particle collection chamber PC that is penetrated by the bearing housing 1*a* shown in FIG. 1 and that has an eccentric conical lower region CN.

The liquid quenchant wall flow layer QL is formed by liquid quenchant discharged from a series of twelve circumferentially spaced holes 7*a* (diameter of 1/16 inch ) in a 12 inch diameter annular manifold tube 7 having a circular tube cross-section and disposed on the cylindrical wall member 9, FIG. 2. The manifold tube 7 is supplied with the same liquid quenchant as nozzles 4 from gear pump GP through liquid quenchant conduit CC and a secondary supply conduit CC3, partially shown in FIG. 1, which is communicated to the manifold tube 7 via pressure control valve V3. The location of the manifold tube 7 is illustrated in FIG. 2.

Preferably in making generally spherical particles, the atomized droplets are cooled to the extent to have at least a solidified surface shell before they impact the outermost liquid quenching flow layer QL proximate the tubular wall member 9. Even more preferably, the atomized droplets will be substantially solidified through the droplet diameter. The tubular wall member 9 is disposed outwardly of the series of liquid quenching sheets 2*a*, 2*b* such that the atomized droplets D will contact the liquid quenching wall flow layer QL after passing through the curtains or sheets 2*a*, 2*b* for final and full droplet cooling and soldification as substantially undistorted, generally spherical (or other shape) particles. The liquid quenching wall flow layer QL entrains and carries the powder particles via the particle collection chamber PC and a conduit CP to a collection chamber 5 disposed within the reservoir or source S. The liquid quenching wall flow layer typically comprises the same quenchant composition as that discharged from nozzles 4 for curtains or sheets 2*a*, 2*b*, although the invention is not limited in this regard.

The thin liquid quenching curtains or sheets 2*a*, 2*b* and the liquid quenching wall flow layer QL proximate the cylindrical wall member 9 provide rapid incremental cooling of the atomized droplets D to provide fine powder particle microstructures and enhanced powder particle physical properties as well as gradual deceleration of the atomized droplets during their flight from the disk 1 without the distortion from the generally spherical shape that otherwise could result from sudden impact with a massive quench bath or medium. In this way, the invention is especially useful for, although not limited to, producing rapidly cooled atomized generally spherical powder particles.

Referring to FIG. 1, the liquid quenching flow layer QL proximate the tubular wall member 9 entrains and carries the solidified powder particles to the powder collection container or chamber 5 disposed in the liquid quenchant reservoir or source S. After the melt in crucible 3 has been atomized, the powder particles collected in the container 5 are allowed to settle to the bottom of the collection container or chamber 5 to separate from the liquid quenchant for further processing of the powder particles. During continuous operation, the quenchant is allowed to overflow the top of the container 5 through a screen filter F on the container top to remove powder particles from the liquid quenchant. The liquid quenchant then is available for pumping from source S by the aforementioned gear pump GP via conduits CC, CC1, CC2, CC3 to the manifolds between plates MP and to the manifold tube 7 as the melt batch in crucible 3 is continuously atomized. After an atomization run, the container 5 with collected powder particles can be removed from the reservoir or source S for more convenient removal of the powder particles. A valve VV in conduit CP is open for particle collection and closed for initial evacuation of chamber C.

Figure 5:
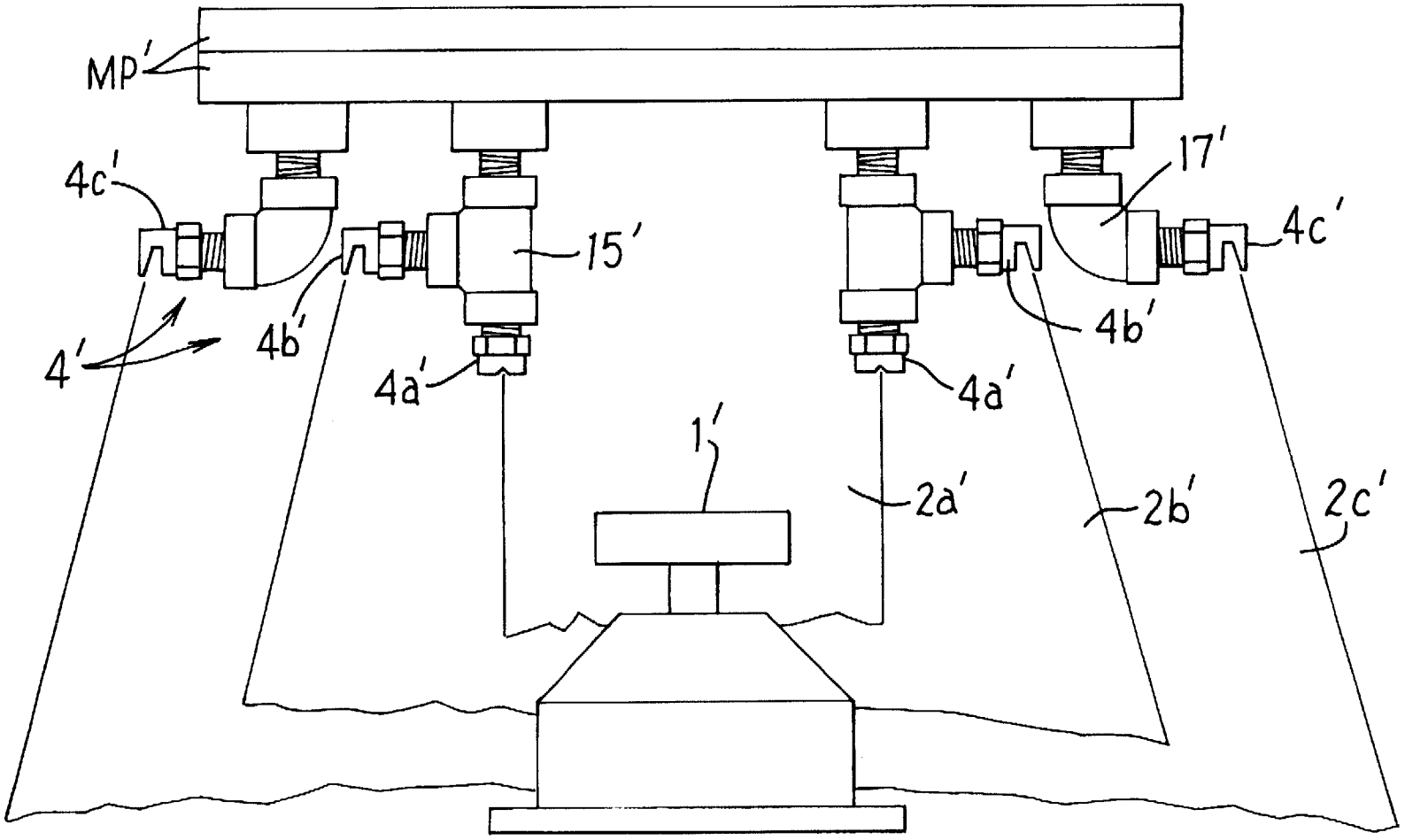
FIG. 5 is a partial schematic side elevation of the centrifugal atomizing disk and three concentric, polygonal cross-section liquid quenching curtains or sheets through which atomized droplets from the atomizing disk pass in succession.
Figure 6:
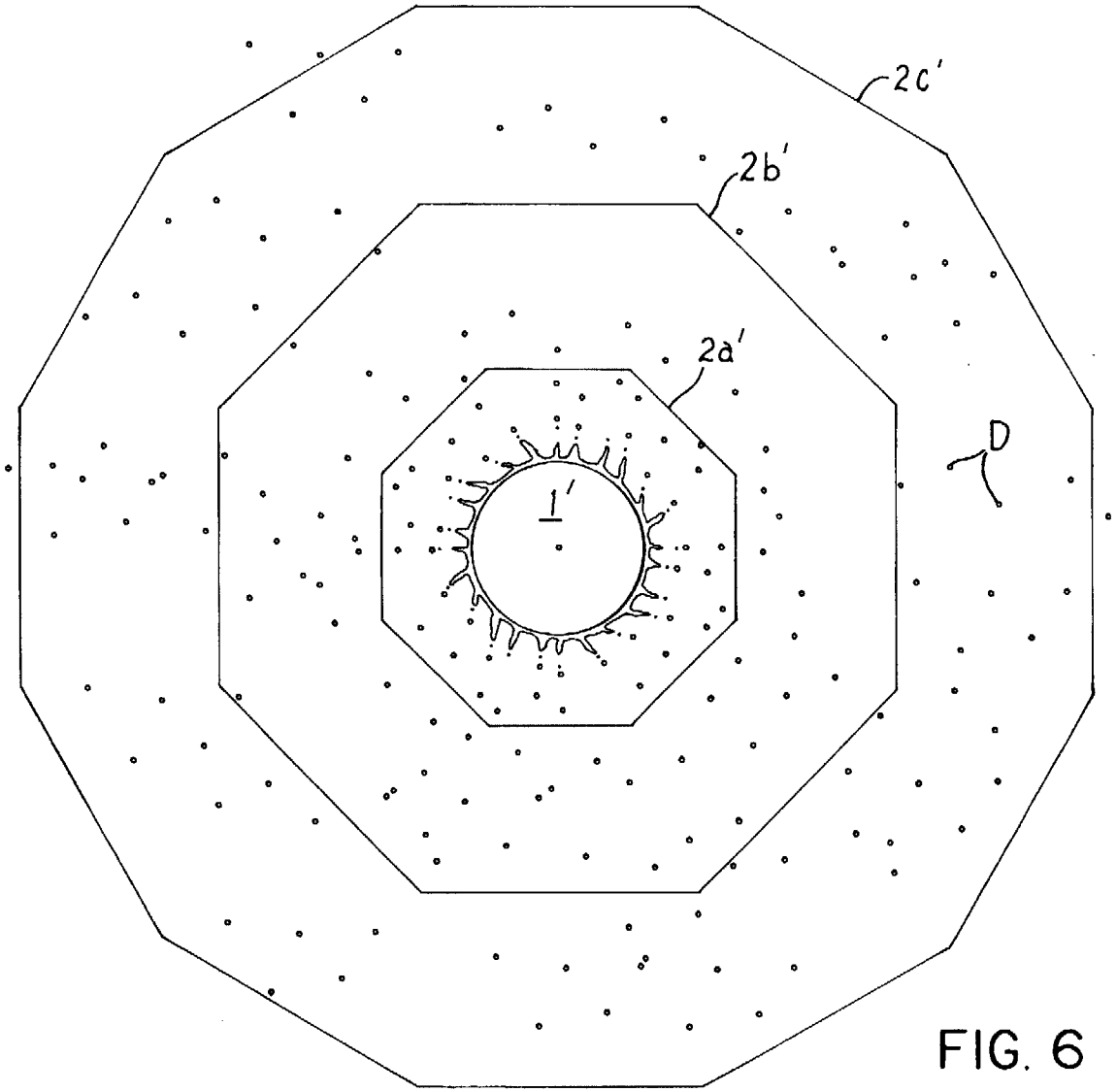
FIG. 6 is a schematic top elevational view of the atomizing disk illustrating atomized droplets leaving the disk and penetrating the three liquid quenching curtains or sheets represented schematically in cross section as solid lines.

Referring to FIGS. 5 and 6 where like features of FIGS. 1–4 are represented by like reference numerals primed, another embodiment of the invention is illustrated as having a series of three liquid quenching curtains or sheets 2*a*', 2*b*', 2*c*' generated by nozzles 4' disposed between the atomizing disk 1' and the aforementioned liquid quenching wall flow layer (not shown) proximate the tubular wall member, see FIGS. 1–2. In this embodiment, type WF, flat spray nozzles #10 with 80 degree spray angle arranged in a circular patern can be used as nozzles 4*a*' for generating the inner liquid quenching curtain or sheet 2*a*' and type AF, low velocity, high volume flood nozzles #20 arranged in respective circular patterns of respective greater diameters can be used as nozzles 4*b*', 4*c*' for generating the intermediate and outer liquid quenching curtains or sheets 2*b*' and 2*c*'. The #10 or #20 designation by the nozzle manufacturer, Delevan-Delta, Inc., is explained hereabove. Nozzles 4*a*' and 4*b*' are mounted on a common "T" pipe fitting 15' as shown in FIG.

5, while nozzles 4c' are mounted on individual elbow fittings 17' for convenience.

In an illustrative embodiment of the invention using these aforementioned nozzles, the inner curtain or spray 2a' can be generated by eight (8) nozzles spaced 45 degrees apart at a radius of 2 inches from the axis A and spraying straight down. The intermediate curtain or spray 2b' can be generated by eight (8) nozzles spaced 45 degrees apart at a radius of 3.5 inches from the axis A and spraying outwardly at an angle of 15 degrees from vertical. The outer curtain or spray 2c' can be generated by twelve (12) nozzles spaced 30 degrees apart at a radius of 5.5 inches from the axis A. These nozzles can spray straight down or outwardly at an angle of 15 degrees from vertical. This embodiment illustrates that additional liquid curtains and sheets may be employed in the practice of the invention and generated by different nozzles.

The following Examples are offered to further illustrate, and not limit, the invention.

EXAMPLE 1

An alumina melting crucible 3 was charged with 217 grams of an Er-9.47 weight % Ni-9.58 weight % Sn master alloy prepared by cold-hearth arc-melting. The charge was induction melted after the chamber C was evacuated to $10^{-5}$ atmospheres and then pressurized with high purity argon to 1.1 atmopsheres. The melt was heated to a temperature of 2690 degrees F. (1475 degrees C.) and then fed to the atomization disk 1 by gravity flow upon raising of an aluminum oxide stopper rod.

The atomization disk 1 (comprised of a 0.010 inch tantalum sheet atop 0.300 inches zirconia felt, atop a 0.500 inch thick aluminum oxide disk) was spinning at 5500 rpm when contacted by the melt. The melt impacted the center of the atomization disk and flowed across the disk surface to the disk periphery, a total of 1.0 inch. The melt was broken into droplets at the disk periphery, and each droplet impacted a series of two vertical spray curtains or sheets 2a, 2b of liquid quenchant comprising polydimethyl siloxane fluid—Dow 200 silicone fluid—5 centistokes viscosity). The inner spray curtain or sheet 2a was generated by eight of the aforementioned type LF, flat spray nozzles #10 (nozzles 4a) at a supply quenchant pressure of 2 psi and radius of 2 inches from axis A. Twelve of the aforementioned type LF, flat spray nozzles #20 at a supply quenchant pressure of 3 psi and radius of 3 inches from axis A were used as nozzles 4b for generating the outer liquid quenching curtain or sheet 2b. The outermost quenchant wall flow QL was created by a supply pressure of about 5 psi on the supply conduit CC3, generating quenchant discharge flow QL through the twelve orifice discharge holes 7a in the manifold tube 7.

The mass median particle size of the resulting powder was approximately 240 microns with about 258 grams of powder recovered. Particles between 300 and 106 microns were flake shaped with some spherodial and some ligamented particles. Particles smaller than 106 microns were predominantly liagmented with some flakes and some spheres and partial spheres.

EXAMPLE 2

A tantalum melting crucible 3 was charged with 500 grams of Nd metal. The charge was induction melted after the chamber C was evacuated to $10^{-5}$ atmospheres and then pressurized with high purity argon to 1.1 atmospheres. The melt was heated to a temperature of 2012 degrees F. (11005 degrees C.) and then fed to the atomization disk 1 by gravity flow upon raising of an aluminum oxide stopper rod.

The atomization disk 1 (comprised of a 0.010 inch tantalum sheet atop 0.300 inches zirconia felt, atop a 0.500 inch thick aluminum oxide disk) was spinning at 5415 rpm when contacted by the melt. The melt impacted the center of the atomization disk and flowed across the disk surface to the disk periphery, a total of 1.0 inch. The melt was broken into droplets at the disk periphery, and each droplet impacted a series of two vertical spray curtains or sheets 2a, 2b of liquid quenchant comprising polydimethyl siloxane fluid—Dow 200 silicone fluid—5 centistokes viscosity). The inner spray curtain or sheet 2a was generated by eight of the aforementioned type LF, flat spray nozzles #10 at a supply quenchant pressure of 5 psi and radius of 2 inches from axis A were and twelve of the aforementioned type LF, flat spray nozzles #20 at a supply quenchant pressure of 5 psi and radius of 3 inches from axis A were used as nozzles 4b for generating the outer liquid quenching curtain or sheet 2b. The outermost quenchant wall flow QL was created by a supply pressure of about 5 psi on the supply conduit CC3, generating quenchant flow through the twelve orifice discharge holes in the manifold tube 7.

The mass median particle size of the resulting powder was approximately 140 microns with about 176 grams of powder recovered. Auger anaylsis showed a silicon oxide layer on the surface of the powder particles. Particles between 300 and 180 microns ranged from spherical to semi-spherical with some flattening with few flakes or ligaments particles present.

Although particular embodiments of the invention have been described in detail hereabove for purposes of illustrating the invention, it is to be understood that variations and modifications can be made therein within the scope of the invention as set forth in the appended claims.

We claim:

1. Method of making metallic powder particles, comprising:

atomizing a metallic melt at an atomizing location in a manner to form molten droplets having generally spherical droplet shape moving in a direction away from said atomizing location, and passing the atomized droplets through a plurality of thin, generally flat liquid spray quenching sheets disposed in succession about the atomizing location with each successive quenching sheet being at an increasing distance from said atomizing location so that said atomized droplets pass through the liquid spray quenching sheets in succession with said quenching sheets being thin enough in a cross-sectional dimension transverse to said direction that said droplets are incrementally cooled by contact with said quenching sheets as they pass therethrough without substantially distorting the generally spherical droplet shape.

2. The method of claim 1 including the further step of impinging the cooled atomized droplets on an annular liquid quenchant layer flowing in a downward direction generally parallel with an outer atomizing chamber wall outwardly of said plurality of said liquid spray quenching sheets to produce generally spherical particles in a size range from about 50 to about 1000 microns diameter.

3. The method of claim 2 further including entraining the cooled atomized droplets in said liquid quenchant layer and carrying the cooled atomized droplets to a collection chamber.

4. The method of claim 3 further including separating the cooled atomized droplets from the liquid quenchant.

5. The method of claim 1 comprising atomizing said metallic melt at said atomizing location by supplying said metallic melt to a rotating member that centrifugally ejects molten droplets away from said atomizing member.

6. The method of claim 5 comprising supplying said metallic melt to a rotating refractory disk.

7. The method of claim 5 including disposing said plurality of liquid quenching sheets concentrically around an axis of said atomizing location and at successively increasing distances from said atomizing location.

8. The method of claim 1 comprising atomizing said metallic melt in a non-reactive or inert atmosphere or under a relative vacuum as compared to ambient pressure.

9. The method of claim 1 comprising forming each of said liquid quenching sheets by discharging liquid quenchant as a generally flat spray from a plurality of discharge nozzles arranged in a circular pattern such that the sprays collectively form a polygonal cross-section quenching sheet.

10. The method of claim 1 wherein at least one of said liquid quenchant sheets or a reactant therein reacts with said atomized droplets to form a protective coating thereon.

* * * * *